US006786818B1

(12) United States Patent
Rothschild et al.

(10) Patent No.: US 6,786,818 B1
(45) Date of Patent: Sep. 7, 2004

(54) GAMING MACHINE WITH INTERACTING SYMBOLS ON SYMBOL ARRAY

(75) Inventors: Wayne H. Rothschild, Northbrook, IL (US); Joel R. Jaffe, Evanston, IL (US)

(73) Assignee: WMS Gaming Inc., Chicago, IL (US)

( * ) Notice: Subject to any disclaimer, the term of this patent is extended or adjusted under 35 U.S.C. 154(b) by 159 days.

(21) Appl. No.: 09/711,970

(22) Filed: Nov. 14, 2000

Related U.S. Application Data

(63) Continuation-in-part of application No. 09/531,712, filed on Mar. 21, 2000, now Pat. No. 6,517,432.

(51) Int. Cl.[7] ..... A63F 9/24

(52) U.S. Cl. ..... 463/20; 436/16

(58) Field of Search ..... 463/16–22, 1, 463/10, 11, 12–13, 25–27, 30–32; 273/138.1, 139

(56) References Cited

U.S. PATENT DOCUMENTS

| | | | | | |
|---|---|---|---|---|---|
| 5,393,061 | A | | 2/1995 | Manship et al. | |
| 5,697,843 | A | * | 12/1997 | Manship et al. | 463/20 |
| 5,980,384 | A | * | 11/1999 | Barrie | 463/16 |
| 6,056,642 | A | | 5/2000 | Bennett | |
| 6,089,977 | A | * | 7/2000 | Bennett | 463/20 |
| 6,095,921 | A | | 8/2000 | Walker et al. | |
| 6,135,885 | A | * | 10/2000 | Lermusiaux | 463/20 |
| 6,224,482 | B1 | * | 5/2001 | Bennett | 463/20 |
| 6,251,013 | B1 | * | 6/2001 | Bennett | 463/13 |
| 6,261,177 | B1 | * | 7/2001 | Bennett | 463/16 |
| 6,270,411 | B1 | * | 8/2001 | Gura et al. | 463/20 |
| 6,290,600 | B1 | * | 9/2001 | Glasson | 463/20 |
| 6,364,766 | B1 | * | 4/2002 | Anderson et al. | 463/16 |
| 6,375,568 | B1 | * | 4/2002 | Roffman et al. | 463/26 |
| 6,419,579 | B1 | * | 7/2002 | Bennett | 463/20 |
| 6,517,432 | B1 | * | 2/2003 | Jaffe | 463/16 |

FOREIGN PATENT DOCUMENTS

| | | | | |
|---|---|---|---|---|
| EP | 60019 A1 | * | 9/1982 | ..... G07F/17/34 |
| WO | WO 99/64997 | | 12/1999 | |
| WO | WO 00/32286 | | 6/2000 | |

OTHER PUBLICATIONS

Advertisement; "Penguin Pays," Aristocrat Incorporated, 1998.
Article; "Wild Cougar," Aristocrat Leisure Industries, *Strictly Slots*, Feb. 1999, pp. 44.
Brochure; "Wild Cougar," Feb. 1994, 2 pp.
Article; "The Full Monty, Shuffle Master, Bally Gaming and Monty Hall bring *Let's Make a Deal* to the slot floor, " *Strictly Slots*, 1999, pp. 48–51.
Product Sheet; "Great Whites," Anchor Gaming, 2000 (but believed to be available about 1998).
Brochure; "Neptune's Pearls," Unidesa Gaming, 1998, 4 pp.
Product Sheet; "Yahtzee Video Game," Mikohn, 2000.
Product Sheet; "Goooaal!," Bally Gaming, Inc., Las Vegas, Nevada, 2000.
Product Sheet; "bigfoot," Shuffle Master, Inc., Las Vegas, Nevada, 2000.
Product Sheet; "Cabby Cash," Anchor Gaming, Las Vegas, Nevada, 2000.
Product Sheet; "Fishin' Buddies," Anchor Gaming, Las Vegas, Nevada, 2000.

(List continued on next page.)

*Primary Examiner*—Jessica Harrison
*Assistant Examiner*—Alex F. R. P. Rada, II
(74) *Attorney, Agent, or Firm*—Jenkens & Gilchrist

(57) ABSTRACT

A gaming machine with a visual display shows an array of symbols that includes one or more special symbols. During the play of the gaming machine, a bonus game may be triggered by the alignment of these special symbols. This bonus triggers interplay between the special symbols, which portray an action that determines a bonus game outcome. The action portrayed is randomly selected from a plurality of possible actions. An award is made based on the game outcome.

66 Claims, 8 Drawing Sheets

OTHER PUBLICATIONS

Product Sheet; "Loaded Dice," Konami Gaming, Las Vegas, Nevada 2000.
Product Sheet; "Congo Quest," Anchor Gaming, Las Vegas, Nevada, 2000.
Product Sheet; "Jackpot Stampede Deluxe," WMS Gaming Inc., Chicago, Illinois, 1997.
Product Sheet; "Stroke of Luck," WMS Gaming Inc., Chicago, Illinois, 1997.

Newspaper; "Big Games Safari," IGT Gaming, Inc., Reno, Nevada, 2000.

* cited by examiner

GAMING MACHINE WITH INTERACTING SYMBOLS ON SYMBOL ARRAY

CROSS-REFERENCE TO RELATED APPLICATION

This application is a continuation-in-part of U.S. pat. application Ser. No. 09/531,712 filed Mar. 21, 2000 and entitled "Gaming Machine With Moving Symbols On Symbol Array," now U.S. Pat. No. 6,517,432.

FIELD OF THE INVENTION

The present invention relates generally to gaming machines and, more particularly, to a video gaming machine with symbols in an array that animate and visually interact with each other.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome of the basic game. Because the bonus game concept offers tremendous advantages in player appeal and excitement relative to other known games, and because such games are attractive to both players and operators, there is a continuing need to develop new features for bonus games to satisfy the demands of players and operators. Preferably, such new bonus game features will maintain, or even further enhance, the level of player excitement offered by bonus games heretofore known in the art. The present invention is directed to satisfying these needs.

SUMMARY OF THE MENTION

A gaming machine comprises a visual display and a game of chance shown on the display. In connection with the game of chance, the visual display shows an array of symbols in visual association with at least one pay line. The array includes one or more special symbols. Each of the special symbols is associated with at least one of the other special symbols. The game of chance includes a plurality of game rounds. During each of the game rounds one or more of the special symbols appear in the array. If a first special symbol appears in a specified proximity to a second special symbol that is associated with the first special symbol, an interplay occurs between the two symbols. The interplay between the special symbols can occur as a part of a basic game round or may comprise a bonus round. The game of chance awards a payout during the round if the symbols along the pay line correspond to a winning game outcome. An interplay between special symbols may affect the location of one or more symbols in the array, thus affecting the game outcome and payout. Additionally, the interplay between special symbols may initiate a different payout schedule based on the results of the interaction.

BRIEF DESCRIPTION OF THE DRAWINGS

The foregoing and other advantages of the invention will become apparent upon reading the following detailed description and upon reference to the drawings in which.

Figure 1:
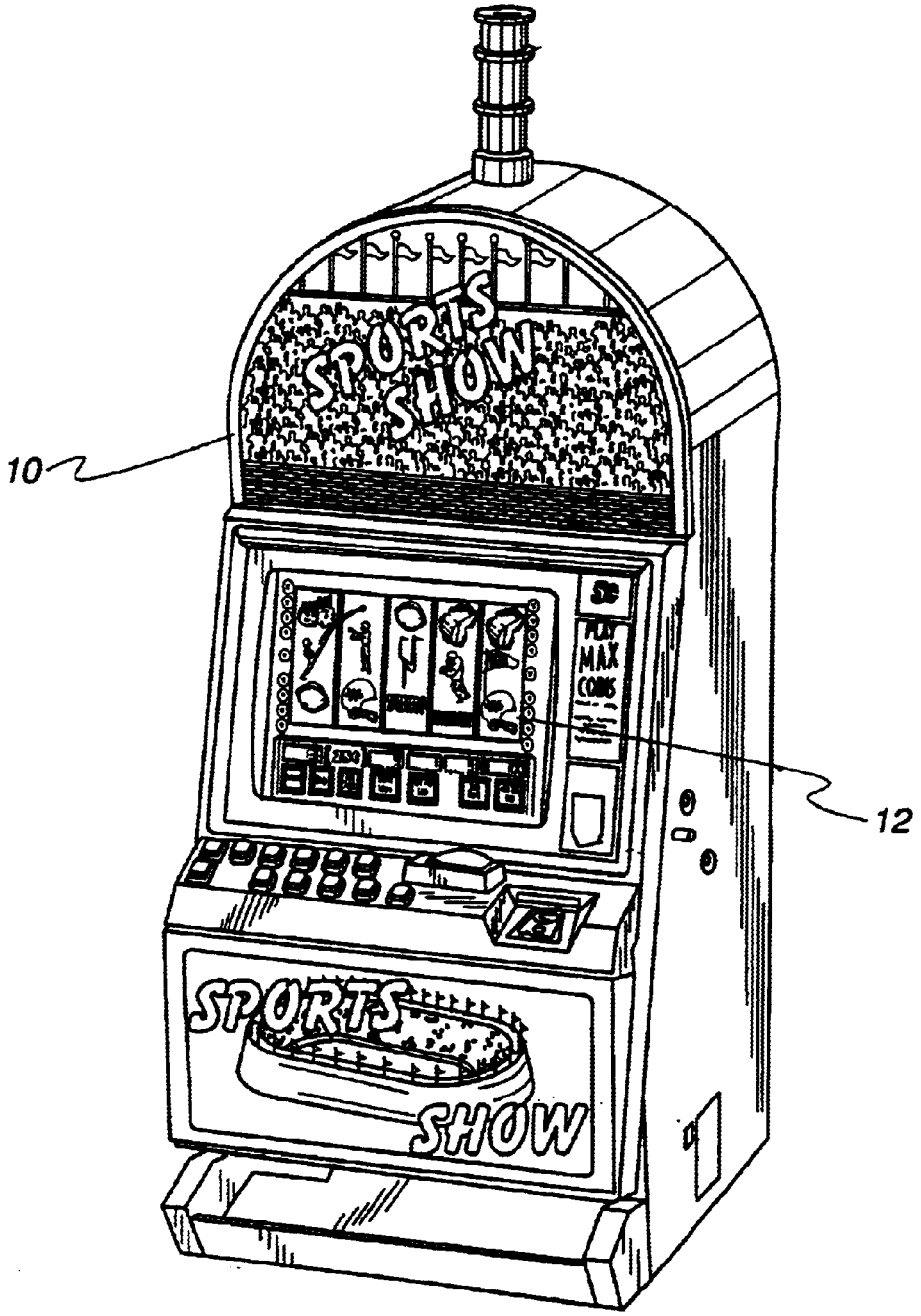
FIG. 1 is a simplified front view of a gaming machine embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, there is depicted a video gaming machine 10 that may be used to implement a bonus game according to the present invention. The gaming machine 10 includes a video display 12 that may comprise a dot matrix, CRT, LED, LCD, electro-luminescent display or generally any type of video display known in the art. In the illustrated embodiment, the gaming a machine 10 is an "upright" version in which the video display 12 includes a touch screen and is oriented vertically relative to the player. It will be appreciated, however, that any of several other models of gaming machines are within the scope of the present invention including, for example, a "slant-top" version in which the video display is slanted at about a thirty-degree angle toward the player.

Figure 2:
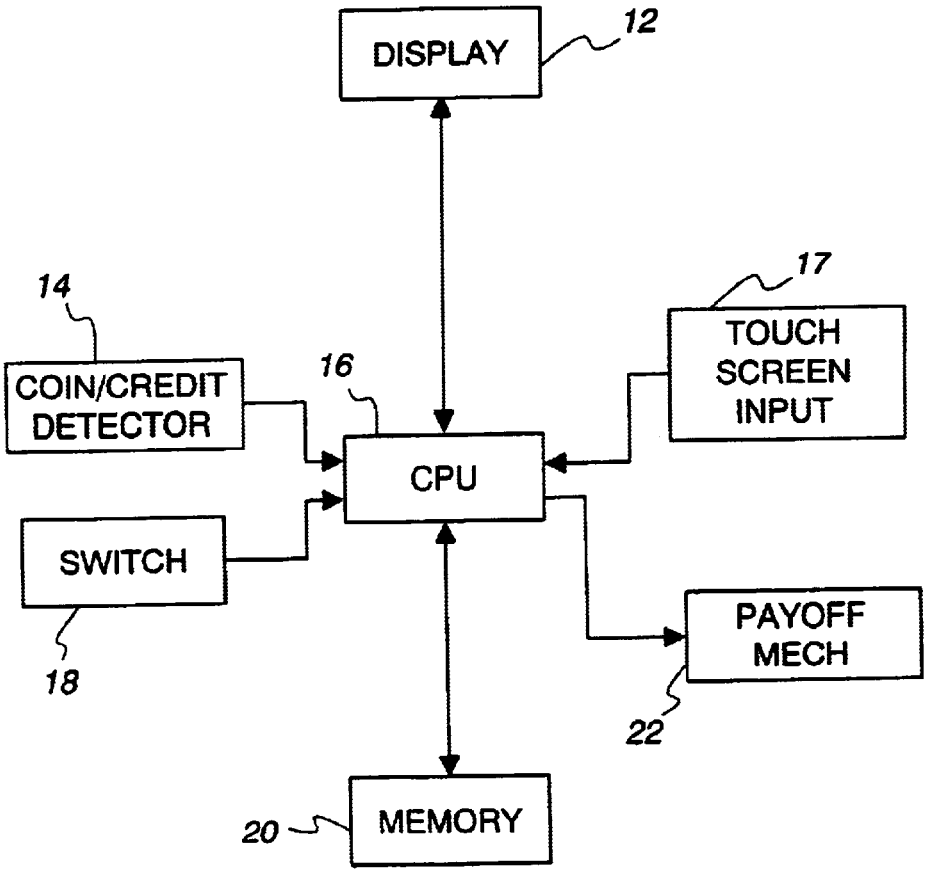
FIG. 2 is a block diagram of a control system suitable for operating the gaming machine.

FIG. 2 is a block diagram of a control system suitable for operating the gaming machine 10. Coin/credit detector 14 signals a CPU 16 when a player has inserted a number of coins or played a number of credits. Then, the CPU 16 operates to execute a game program which causes the video display 12 to display the basic game that includes simulated reels with symbols displayed thereon (see FIG. 3). The player may select the number of pay lines to play and the amount to wager via touch screen input keys 17. The basic game commences in response to the player activating a switch 18 (e.g., by pulling a lever or pushing a button), causing the CPU 16 to set the reels in motion, randomly select a game outcome, and then stop the reels to display symbols corresponding to the pre-selected game outcome. In one embodiment, certain of the basic game outcomes cause the CPU 16 to enter a bonus mode causing the video display 12 to show a bonus game.

A system memory 20 stores control software, operational instructions and data associated with the gaming machine 10. In one embodiment, the memory 20 comprises a separate read-only memory (ROM) and battery-backed random-access memory (RAM). However, it will be appreciated that the system memory 20 may be implemented on any of several alternative types of memory structures or may be implemented on a single memory structure. A payoff mechanism 22 is operable in response to instructions from the CPU 16 to award a payoff of coins or credits to the player in response to certain winning outcomes which might occur in the basic game or bonus game. The payoff amounts corresponding to certain combinations of symbols in the basic game is predetermined according to a pay table stored in system memory 20. The payoff amounts corresponding to certain outcomes of the bonus game are also stored in system memory 20.

Figure 3:
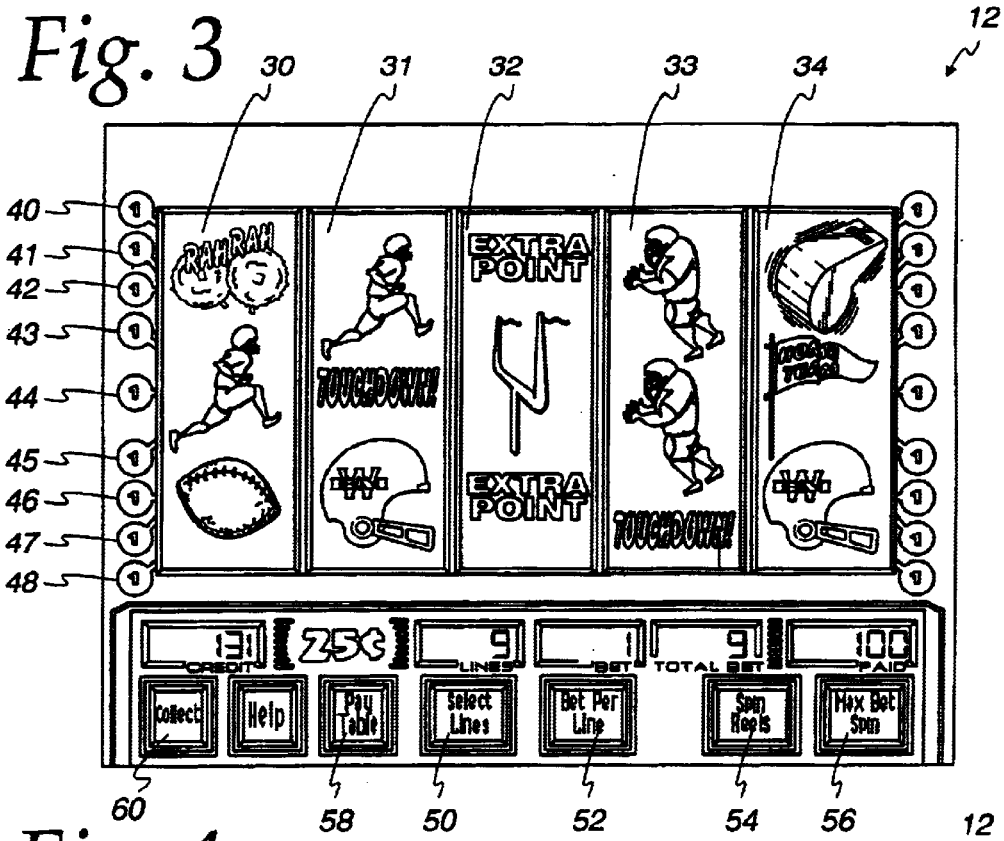
FIG. 3 is a display screen capture associated with a five-reel, nine-line basic game that is played on the gaming machine.

As shown in FIG. 3, the basic game is implemented on the video display 12 on five video simulated spinning reels 30, 31, 32, 33 and 34 (hereinafter "reels") with nine pay lines 40–48. Each of the pay lines 40–48 extends through one symbol on each of the five reels 30–34. Generally, game play is initiated by inserting a number of coins or playing a number of credits, causing the CPU 16 (FIG. 2) to activate a number of pay lines corresponding to the number of coins or credits played. In one embodiment, the player selects the number of pay lines (between one and nine) to play by pressing a "Select Lines" key 50 on the video display 12. The player then chooses the number of coins or credits to bet on the selected pay lines by pressing the "Bet Per Line" key 52.

After activation of the pay lines, the reels 30–34 may be set in motion by touching the "Spin Reels" key 54 or, if the player wishes to bet the maximum amount per line, by using the "Max Bet Spin" key 56 on the video display 12. Alternatively, other mechanisms such as, for example, a lever or push button may be used to set the reels in motion. The CPU 16 uses a random number generator to select a game outcome (e.g., "basic" game outcome) corresponding to a particular set of reel "stop positions." The CPU 16 then causes each of the video reels 30–34 to stop at the appropriate stop position. Video symbols are displayed on the reels 30–34 to graphically illustrate the reel stop positions and indicate whether the stop positions of the reels represent a winning game outcome.

Winning basic game outcomes (e.g., symbol combinations resulting in payment of coins or credits) are identifiable to the player by a pay table. In one embodiment, the pay table is affixed to the machine 10 and/or displayed by the video display 12 in response to a command by the player (e.g., by pressing the "Pay Table" button 58). A winning basic game outcome occurs when the symbols appearing on the reels 30–34along an active pay line correspond to one of the winning combinations on the pay table. If the displayed symbols stop in a winning combination, the game credits the player an amount corresponding to the award in the pay table for that combination multiplied by the amount of credits bet on the winning pay line. The player may collect the amount of accumulated credits by pressing the "Collect" button 60.

The pay table enables the player to view the winning combinations and their associated payoff amounts. In the preferred implementation, the winning combinations start from either the first reel 30 (left to right) or the fifth reel 34 (right to left) and span adjacent reels.

Among the reel symbols used in the game are special symbols. There may be any number of special symbols, and all the symbols may be special. Each of the special symbols is associated with at least one of the other special symbols. If a first special symbol stops in a position proximate to a second special symbol, and the two special symbols are associated, the CPU initiates an interplay between the two special symbols. Each of the groups of associated special symbols may be part of a theme so that the player easily recognizes which symbols are associated. All of the special symbols may be part of a single, more general theme. During the interplay, the special symbols animate and graphically interact with each other. One or more of the special symbols may move outside its space in the array of symbols. The special symbol may then perform an action directed toward or associated with one or more other symbols in the array.

Figure 4:
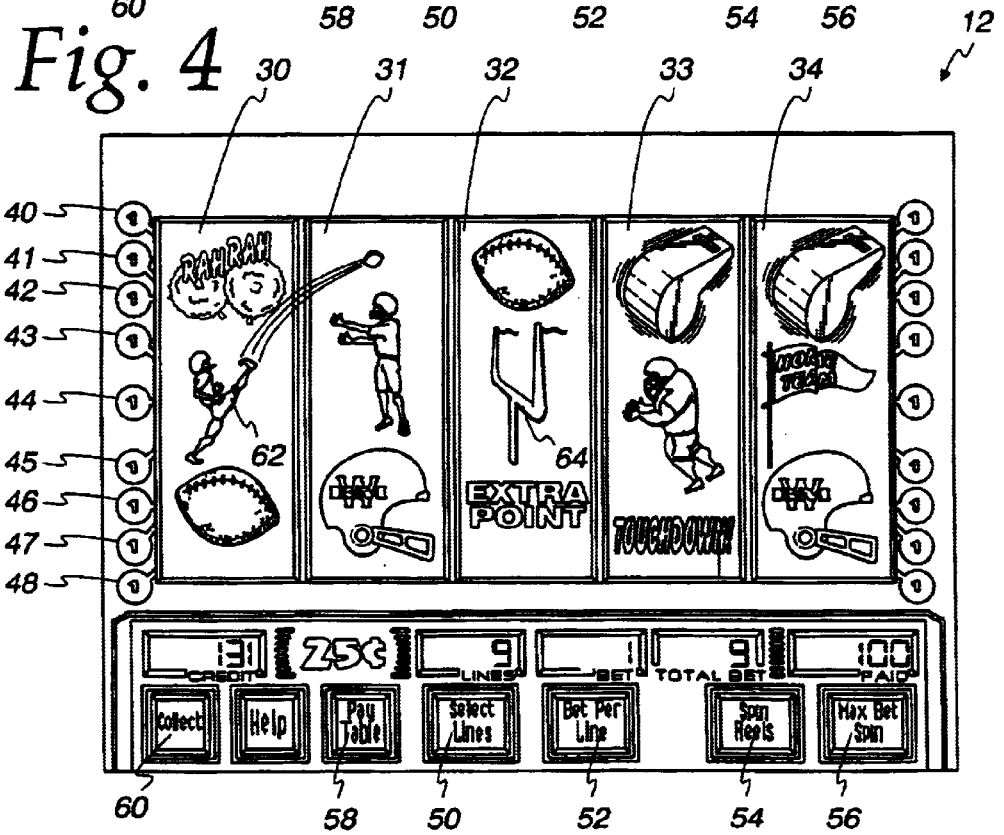
FIGS. 4 through 11 are display screen captures showing interplays between associated symbols.

For example, referring to FIG. 4, in a first embodiment having an American football theme, the special symbols include a symbol of a football kicker 62 and a symbol of a goal post 64. The two special symbols are associated with each other. If during play the kicker and the goal post land along the same pay line (e.g., pay line 44), an interplay between the two special symbols is initiated. The interplay comprises a bonus game in which the kicker attempts to kick a football through the goal post. If the kicker successfully kicks the football, the football travels to other parts of the display where it interacts with other reel symbols, such as blockers, or other graphics on the display, such as a fence or a crowd of people. If the football is kicked before one or more reels has stopped, the football may interact with one or more of the symbols on those reels while the reels continue to move. For example, a blocker on a moving reel may block the football, preventing it from traveling through the goal post. If the kicker is successful in kicking the football, the display will show the football traveling toward and either passing through or missing the goal post. During or after the kick, the display may be changed to show an action screen comprised of a larger view of the goal post so that the player can more easily see the results of the kick. The action screen may be shown around or superimposed upon the former image of the reels. Also, the action screen may be shown on a second video display.

Figure 5:
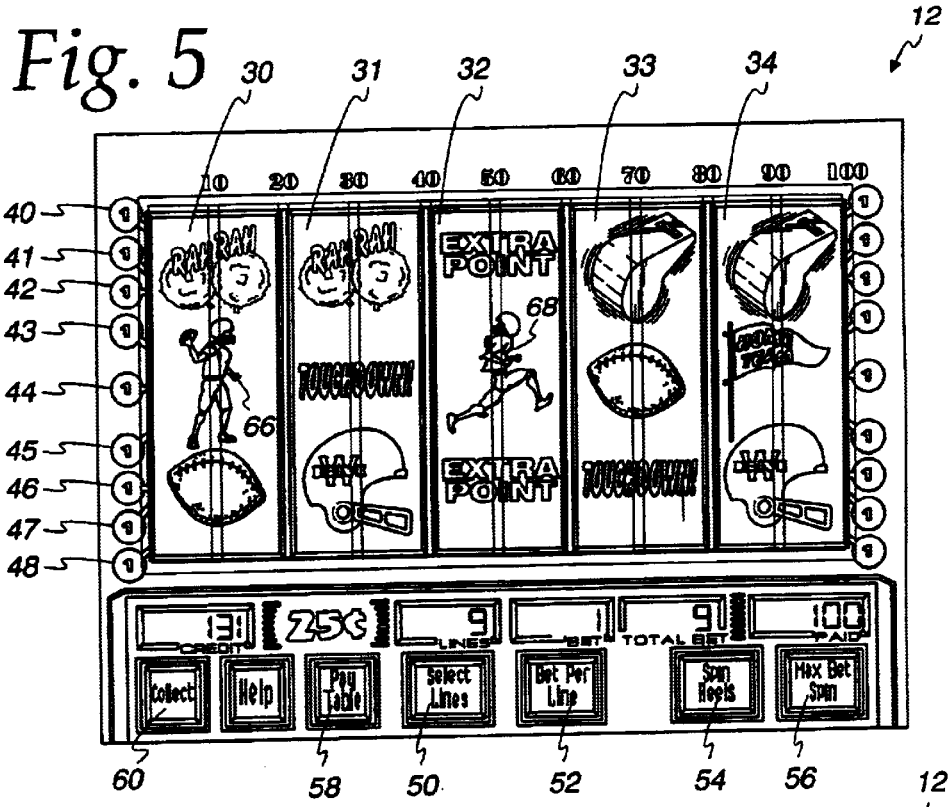
Figure 6:
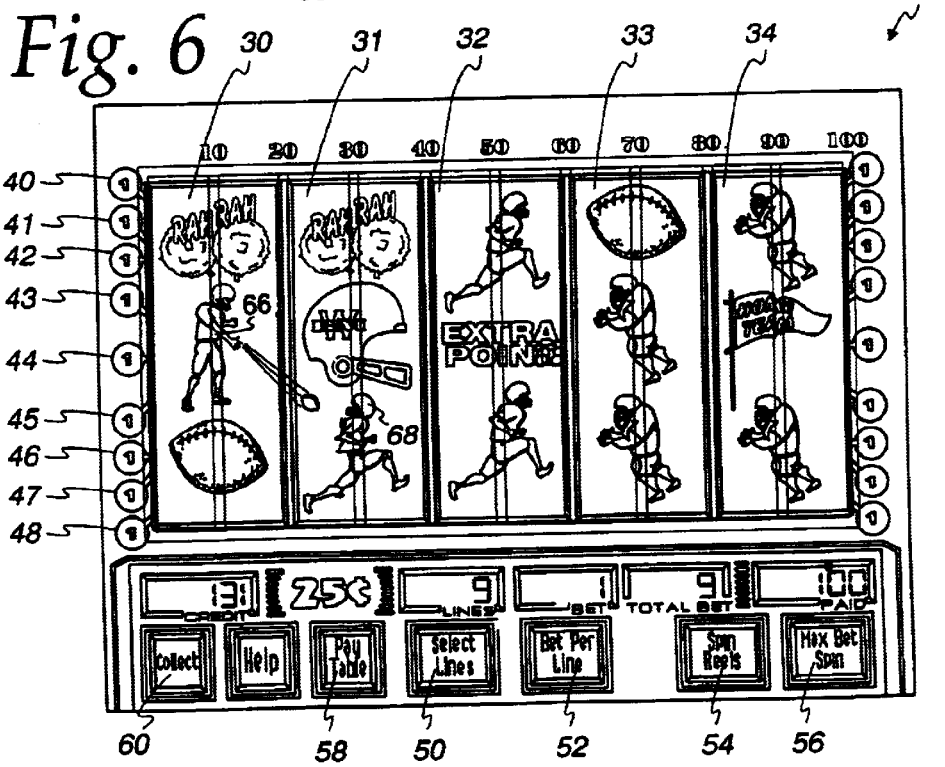
Figure 7:
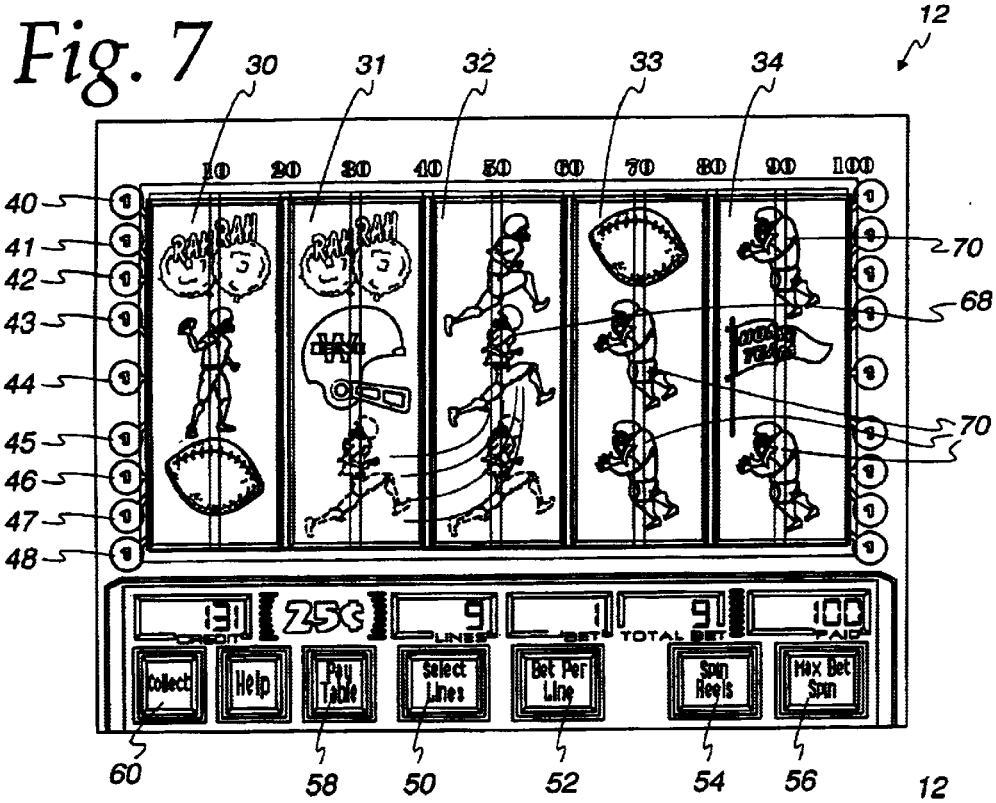

Referring to FIG. 5, two other associated special symbols are a quarterback 66 and a receiver 68. If the quarterback and the receiver land along the same pay line (e.g., pay line 44), an interplay will be initiated in which the quarterback attempts to pass a football to the receiver. If multiple receivers land in the array, all of the receivers might be able to catch football. There also may be a number of defenders in the array. The defenders include interceptors and tacklers. The interceptors attempt to catch the football and the tacklers attempt to tackle a receiver that catches the ball. An action view in this case comprises a diagram of a football field. Again, the action view may be shown around or superimposed upon the former view of the reels. Referring to FIG. 6, if the quarterback 66 passes the football, and a receiver 68 catches it, the receiver 68 runs with the football in an attempt to score a touchdown. Referring to FIG. 7, the receiver 68 can run vertically, that is along one reel, or horizontally from reel to reel. Tacklers 70 that appear on reels in the path of the receiver 68 attempt to tackle and stop the receiver 68. If a tackler 70 lands in a position of the array immediately to the right of the receiver 68, the receiver 68 runs up or down along the reel in an attempt to avoid the tackler 70. However, if all the symbols on the reel to the right of the receiver are tacklers, the tacklers tackle the receiver and stop his progress. If an interceptor catches the football, the interceptor runs in the opposite direction in an attempt to score a touchdown for the opposing team.

It is also possible for a symbol to trigger interplay between two other symbols. For example, if a QBsneak symbol lands next to a quarterback symbol, the quarterback does not attempt to throw the ball, but instead attempts to progress toward the left or right side of the display in order to score a touchdown. The quarterback makes progress in a manner similar to that of the receiver. The quarterback can move up, down, left and right. He may interact with other symbols such as tacklers. If symbols matching the team or color designation of the quarterback land in array positions next to the quarterback, the quarterback can move to those positions. Symbols that match the quarterback's team or color designation may assist the quarterback by moving with him and thwarting the opposing tacklers, just as in a real football game the ball carrier is assisted by his teammates who position themselves between the ball carrier and the opponent team members.

Figure 8:
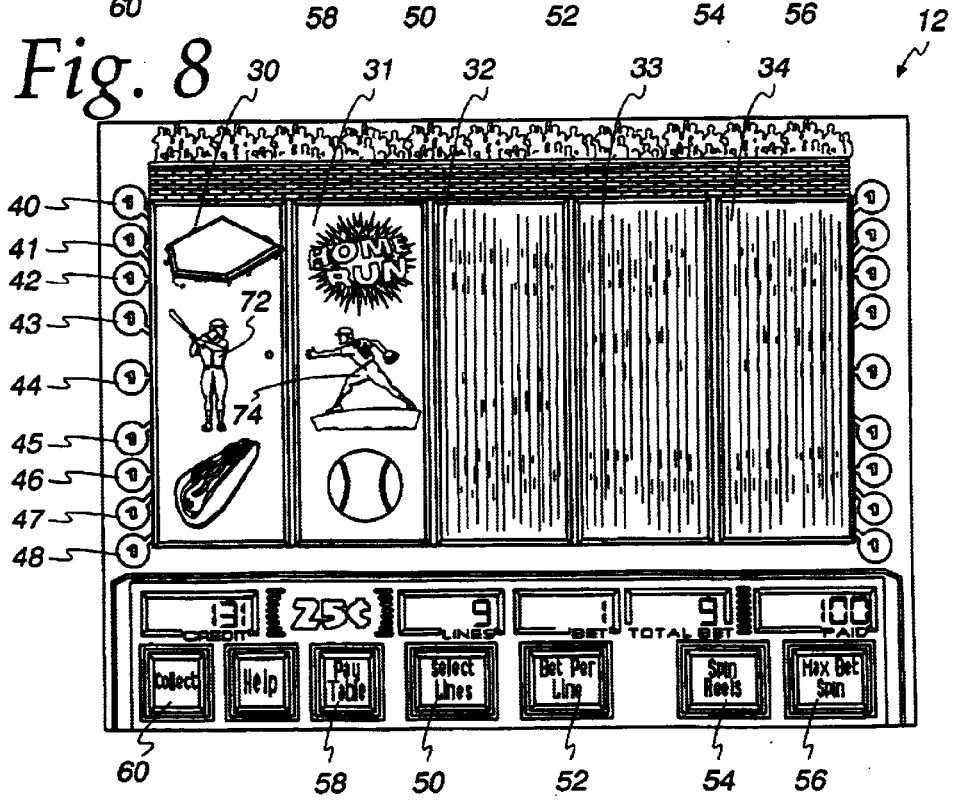
Figure 9:
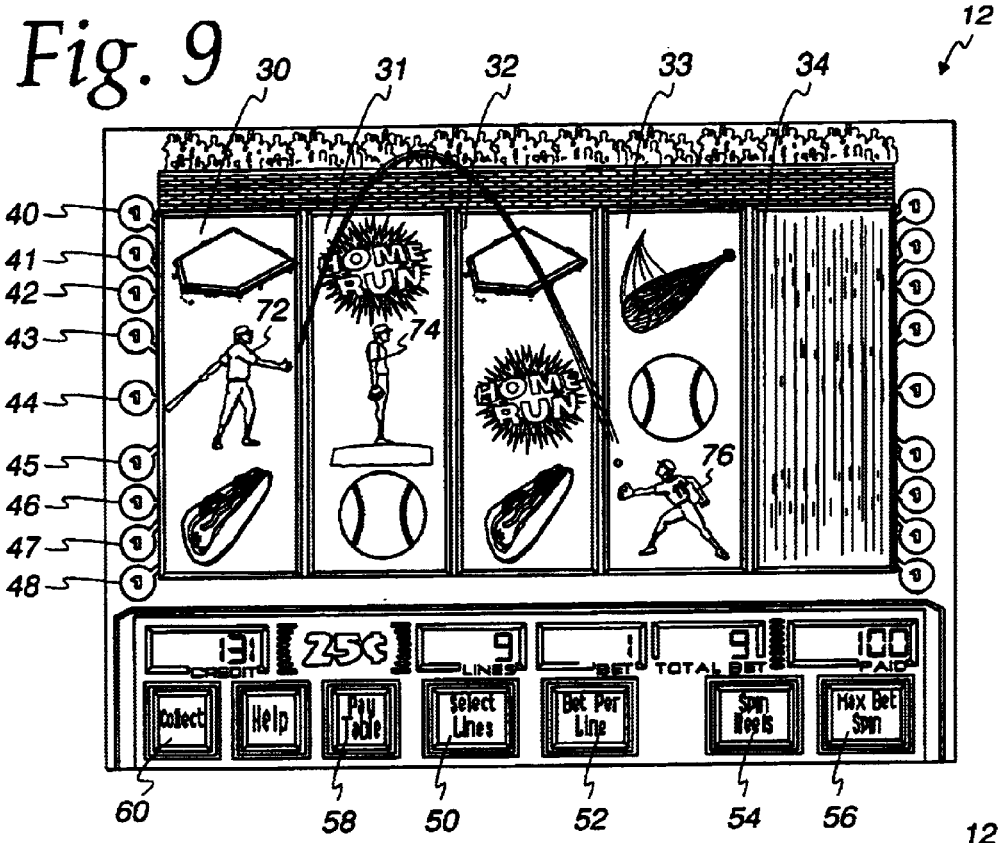

Referring to FIGS. 8 and 9, in a second embodiment having a baseball theme, the special symbols include a symbol of a baseball batter 72 and a symbol of a baseball pitcher 74. The two special symbols are associated with each other. If during play the batter 72 lands along a pay line (e.g. pay line 44), and the pitcher 74 lands along the same pay line and adjacent to the batter, the CPU initiates an interplay between the two special symbols. The interplay comprises a bonus game in which the pitcher throws the ball to the batter and the batter attempts to hit the ball. If the batter hits the ball, the ball travels to other parts of the display where it interacts with symbols on the reels or graphics on the display such as a fence or baseball catchers or fielders. If the ball is hit before one or more reels have stopped, the ball may interact with one or more of the symbols on those reels. For example, as shown in FIG. 9, a baseball fielder 76 on a moving reel may catch the ball. For example, referring to FIG. 8, if the first reel 30 stops with a symbol of a batter 72 in the second row, and the second reel 31 stops with a pitcher 74 in the second row, the CPU initiates an interplay. An action screen is displayed on the screen. The action screen may comprise a diagram of a baseball diamond. In order to distinguish the action screen from the rest of the display, some parts of the display may be made dimmer or less colorful. The color of the symbols on the reels may be made duller so that the action screen is more apparent. The pitcher 74 throws the ball and the batter 72 attempts to hit the ball. If the batter 72 fails to hit the ball, the pitcher 74 may throw another ball to the batter 72, or the interplay may end. If the batter 72 hits the ball, the ball will travel toward the right side of the display. If the ball is not stopped in the second reel 31 by the pitcher 74 or another symbol, it travels toward the third reel 32. The third reel 32 stops and leaves symbols in each of the rows. If no fielder catches the ball on the third reel 32, the ball may land and stop, land and roll, or continue to travel through the air. The fourth and fifth reels 33 and 34 stop similarly as the ball approaches each reel. Alternatively, all of the reels may stop before the interplay initiates. FIG. 9, for example, shows the ball being caught by a fielder 76 on the fourth reel 33.

As in a real baseball game, there are a variety of possible outcomes to a batter hitting a ball. If no fielder stops the ball, the ball may travel beyond the reels and score a homerun. If a fielder catches the ball while it is traveling through the air, the batter is out and the interplay does not increase the player's payout. If the ball is not caught, the batter attempts to run to each of the bases shown on the action screen. The fielders simultaneously attempt to stop the ball and get the ball to a base before the batter. Any aspect of a real baseball game can be incorporated into the game, but the game is not restricted to those rules and possible outcomes that exist in a real game.

The outcome of the interplay may be preselected, randomly selected, or may depend on an input from the player of the game. For example, in the first embodiment, the player may use an input device such as a lever or button to influence the timing of the quarterback's attempt to pass the football, the direction of motion of running receiver or quarterback. Also, the player may use the input device to select the type of play, e.g., run, pass, sneak, punt, etc., executed on the display. In the second embodiment, the player may use an input device to influence the timing of the batter's swing. Participation by the player during the interplay may cause the player to perceive the outcome to depend on the player's skill. Causing the player to think that the player can control some aspect of the interplay can cause increased interest in the game. Despite any perceived skill generated by the interplay, any payout or bonus is substantially determined by the CPU, not the player, because the gaming machine executes a game of chance, not skill. The player may also control aesthetic aspects of the game or interplay such as the team or color designations of the symbols.

In some embodiments, the CPU initiates the interplay even if the associated special symbols do not land next to each other in the same pay line. For example, the CPU may initiate the interplay if the associated symbols land anywhere in the same line, next to each other but in different lines, or anywhere in the symbol array.

Figure 10:
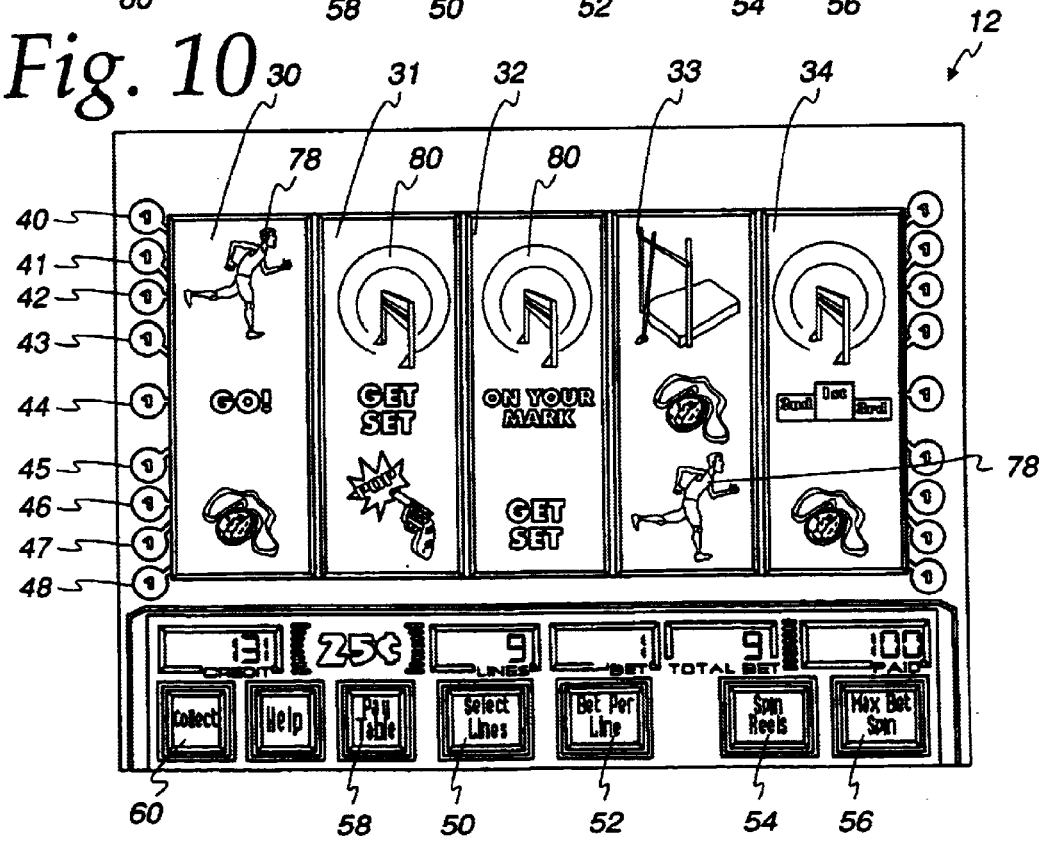
Figure 11:
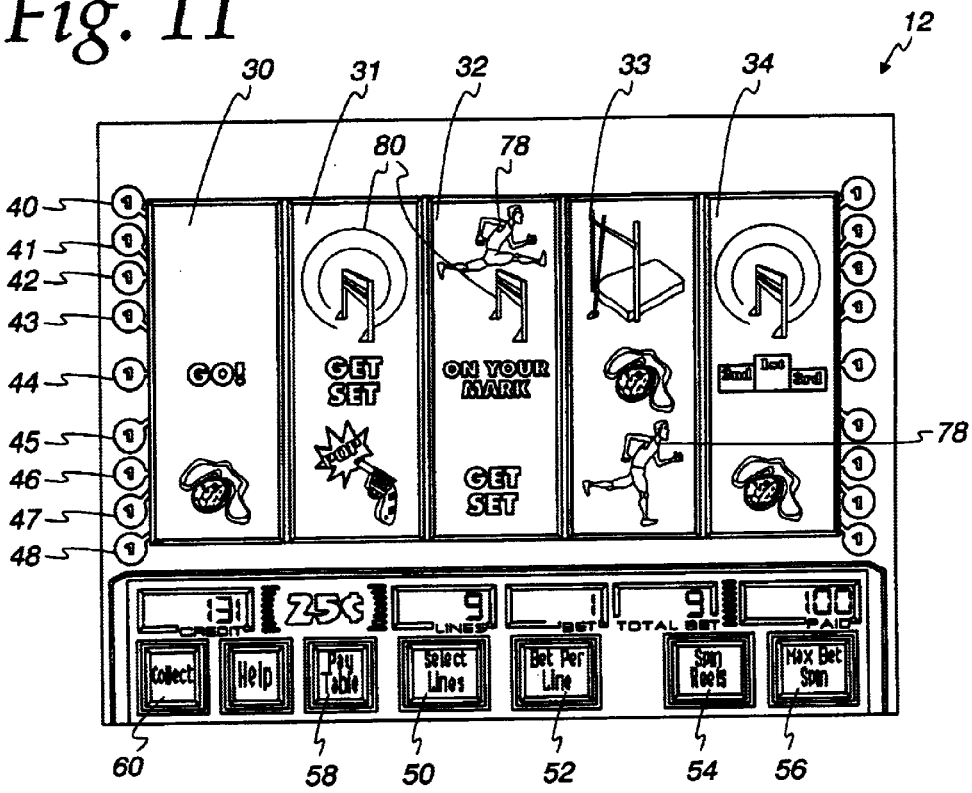

In a third embodiment shown in FIGS. 10 and 11, the game has a theme generally relating to track and field events. Special reel symbols include hurdlers 78, hurdles 80, long jumpers, pits, pole vaulters, and bars. The hurdlers 78 are associated with the hurdles 80, the long jumpers are associated with the pits, and the pole vaulters are associated with the bars. If the hurdler 78 lands adjacent to a hurdle 80, as in FIG. 10, the CPU initiates interplay. The interplay is an additional part of the round. The hurdler 78 is shown leaving its space in the array and jumps over the hurdle 80. As shown in FIG. 1, if several consecutive hurdles 80 land in the same pay line (e.g., pay line 42) as the hurdler 78, the hurdler 78 attempts to jump over all of the hurdles 80. Similarly, if a long jumper lands next to a pit or a pole vaulter lands near a bar, the CPU initiates interplay of the associated special symbols.

It should be understood that the present invention anticipates a multitude of variants on the rules relating to interplay. For example, the CPU may initiate interplay of two symbols even if the symbols are not directly associated with each other. In the track and field example above, the pole vaulter symbol is not directly associated with the hurdle symbol. If a pole vaulter lands next to a hurdle, the pole vaulter might attempt to jump the hurdle but fail. Alternatively, the indirectly associated symbol can perform well but in an unorthodox manner. For example, if a pay line connects a pole vaulter with several hurdles, the pole vaulter might use a pole vault to launch himself over the several hurdles in one bound instead of jumping each hurdle separately like a hurdler.

The present invention contemplates an unlimited number of theme variations. The special symbols of a game can relate to many different categories. Preferred themes are those that include a number of elements which are known to be associated. Possible themes include sports or games, people or personalities, animals, common objects, and vehicles. Among the possible categories in sports are football, basketball, baseball, golf, hockey, volleyball, soccer, bowling, and archery. The interplay between symbols will normally be adapted to correspond to the type of the symbols. For example, in a game with a basketball theme, special symbols may include a shooter and a hoop. One possible form of interplay would be for the shooter to attempt to throw a basketball through the hoop. The rules of the interplay may also be adapted depending on the theme. In the basketball example, the shooter might throw the ball if the player and the hoop land anywhere in the pay line or anywhere in the array of symbols. The distance between the shooter and the hoop at the time of the throw may depend on how far the hoop landed from the shooter in the array of symbols. This may also affect the probability that the shooter successfully throws the ball through the hoop, thus affecting the payout.

A number of common objects can be incorporated into a game. One example is a game that has symbols including a lock and a key. The lock and key are associated symbols. If they land proximate to one another in the array, the key is inserted into the lock to open it. The key might open the lock, or if the key is the wrong key for the lock, it will not open the lock. Other pairs of common objects that are associated are two pieces of a puzzle or a cupid and a heart. Preferred objects are those that can be used in an interplay wherein symbols can be made to interact graphically in an action that is commonly associated with the symbols.

A game with a personality theme could include generic symbols of people of different professions. A fireman symbol could be associated with a fire engine, a burning building, or a cat in a tree. A cowboy symbol could be associated with horses, cows, or ropes. The game can also include symbols of specific people that are associated with an object or action.

A game may incorporate more than one theme or category. For example, a general sports game could include symbols representing elements from the themes of basketball, hockey, and football.

The CPU may adjust or supplement a player's payoff based on the outcome of the interplay. An interplay between special symbols may affect the location of one or more reel symbols in the array, thus affecting the initial game outcome and associated payout. For example, in the first embodiment, if a special symbol of a kicker kicks a football, the football may contact and move or otherwise affect another symbol in the array. Alternatively, if a receiver is running in an attempt to score a touchdown, the receiver might be tackled by a tackler on another reel. Rather than stopping the receiver instantly, the tackler may be pushed for a distance by the receiver. Thus the tackler could be pushed or dragged by the receiver to a location in the symbol array other than the location where the tackler had originally landed when the reels stopped. A payout may be determined in part by the arrangement of the symbols in the array before the interplay, after the interplay, or both. Thus, an interplay that affects the symbol array may increase or decrease the payout. For example, the payout schedule may include a payout for having one of several pay lines filled with tacklers. If a tackler is pushed by a receiver to a new position so that the tackler now fills a pay line with tacklers, the player will be awarded a payout that otherwise would not have been awarded. The payout may be equal or different to the payout that would have been awarded had the same pay line combination been made at the time that the reels stopped, that is without the change caused by the interplay.

Alternatively, a payoff adjustment may depend on whether the associated symbols of an interplay successfully interact. Successful interactions in the football embodiment described above include a kicker kicking the football through the goal post and a quarterback passing a football to a receiver. The interplay between special symbols may initiate a different payout schedule. For example, an interplay can cause changes to the payout schedule, so that symbol combinations result in payouts other than the payout that would have occurred without the interplay. In the baseball game described in the second embodiment, a change to the payout schedule might be effected if a batter hits the ball and runs to a base. For example, if the batter gets to second base, the payout might be doubled.

Alternatively, an interplay may cause a specific payout as determined by an interplay payout schedule. With reference to the football embodiment, an interplay payout schedule might appear as follows:

| Interplay Result | PAY |
|---|---|
| Quarterback passes football | 10 |
| Receiver catches football | 25 |
| Receiver advances ten yards or one reel | 10 |
| Receiver scores a touchdown | 100 |
| Kicker kicks the football | 10 |
| Ball goes through the goal post | 35 |
| Quarterback advances ten yards or one reel | 5 |
| Quarterback scores a touchdown | 100 |

As can be seen from the table, the payout depends on the results of the interplay. Successive events in an interplay can successively increase the total payout. For example, if a quarterback passes a football, the payout would be increased by 10. If, in the same interplay, the receiver catches the football, the payout would be further increased by 25. If the receiver then runs twenty yards before being tackled, the payout is further increased by 20.

Additionally, the outcome of an interplay may affect the initialization or scoring of a subsequent interplay. For example, in a first interplay a quarterback passes a football, a receiver catches the football, and the receiver runs with the football half the length of the football field. If the quarterback and receiver land in the pay line in a later game round, a second interplay will initiate. In the second interplay, the diagram of the football field is positioned so that the quarterback stands at the midpoint of the football field. If the quarterback passes the football in the second interplay, and a receiver catches the football, the receiver will have a shorter distance to run in order to score a touchdown. Alternatively, the first interplay may affect the scoring of the second interplay. For example, if a receiver scores a touchdown in the first interplay, the interplay payout schedule may be modified so that if a receiver scores a touchdown in the second interplay, the player receives a larger payout for the second touchdown than for the first touchdown. By linking the results of an interplay to the initialization or scoring of a subsequent interplay, the player's excitement can be enhanced and the player may be more eager to continue to play successive rounds of the same game.

Instead of or in addition to affecting initialization or scoring of a subsequent interplay, an interplay may trigger a second screen bonus round. For example, if a touchdown results from an interplay of symbols having an American football theme, the successful interplay could trigger a second screen bonus in which a field goal or extra point is attempted. The amount of bonus generated by the second screen bonus may, for example, depend the distance of the field goal and whether or not the field goal is made.

Another aspect of the invention is the use of thematic pay lines. Scatter pay lines are often used in gaming machines to increase the number of possible ways for a player to win. While the use of scatter pay lines does not necessarily increase the player's overall odds of winning, a greater number of possible winning combinations can heighten the player's interest in the game. Many games use scatter pay lines to increase the number of pay lines to fifteen, and it is possible to have hundreds of scatter pay lines even on a five reel game. As the number of pay lines increases, however, players may become less able to identify winning combinations. That is, with so many possible winning combinations, a player may be confused or unaware whether a particular symbol array combination after the reels have rotated and stopped is a winning combination.

In one embodiment of the present invention, scatter pay lines are made more understandable to the player by tying the configuration of the pay lines to the theme of the game. For example, in the football game of the first embodiment described above, a player might win along a linear pay line if symbols of a specific team or color designation form a line from left to right across the reels. A player could win along a scatter pay line if there is a chain of symbols of a specific team or color designation, with each symbol in the chain next to or diagonal to reel symbols of the same team or color designation. Thus, the pay lines might represent the possible paths that a quarterback could run along to score a touchdown. In the baseball game described in the second embodiment above, a scatter pay line could take a number of forms such as a diamond shape that traces an overview of a baseball diamond that is used in the action screen. If a particular combination of symbols, such as all identical symbols, lands in the diamond-shaped pay line, a payout is awarded.

Additionally, an interplay can be used to illustrate the path of a pay line. In the baseball game, for example, if identical reel symbols land on a diamond-shaped pay line, the CPU initiates an interplay in which one or more of the symbols move along the path of the pay line.

Figure 12:
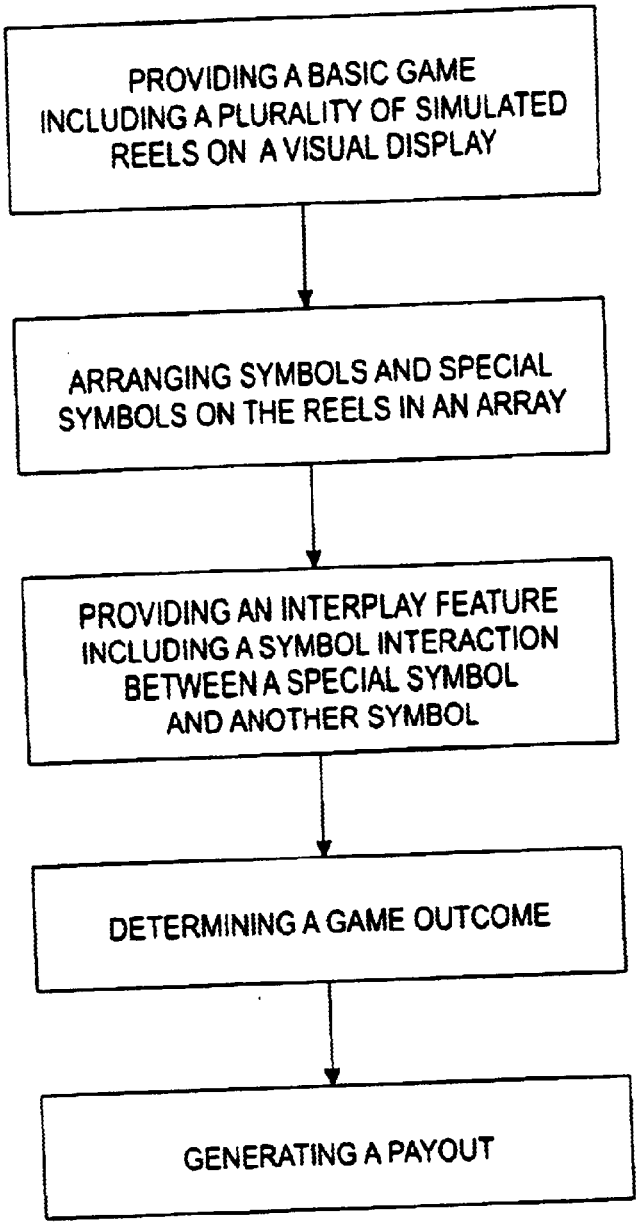
FIG. 12 is a block diagram illustrating one general method of operating a slot machine.

Aspects of the game other than the pay line patterns may also relate to the theme of the game. In the football game, for example, ten reels could be used so that each reel corresponds to a ten-yard designation on an American football field of the action screen. The number of reels could be increased or decreased between game rounds depending on the remaining distance required to score a touchdown. The game play methodology, which has been previously described, is shown generally in FIG. 12.

While the present invention has been described with reference to one or more particular embodiments, those skilled in the art will recognize that many changes may be made thereto without departing from the spirit and scope of the present invention. For example, the basic game need not comprise a spinning reel slot machine game as illustrated in FIG. 1, but may comprise virtually any type of game of chance or skill or combination of games having outcomes that trigger interaction between special symbols on the video display 12. For example, the game may comprise a video poker or video blackjack game in which interplay occurs between symbols on the backs of the cards. The game may itself be implemented on the video display 12 or a separate video display. The interplay between special characters may occur using the background previously displayed during the spinning of the reels. Alternatively, the background may be adapted, or a new background may be constructed, for the interplay. Each of these embodiments and obvious variations thereof is contemplated as falling within the spirit and scope of the claimed invention, which is set forth in the following claims.

What is claimed is:

1. A slot machine comprising:

a basic game controlled by a processor in response to a wager amount, the basic game including a plurality of simulated reels on a visual display, the reels being rotated and stopped to arrange symbols on the reels in an array, the symbols on the reels including one or more special symbols; and an interplay feature activated by the processor in response to at least one of the special symbols appearing in the array, the interplay including a symbol interaction randomly selected from a plurality of possible symbol interactions between the special symbol and at least one other symbol, the selected symbol interaction to determine a game outcome from a plurality of possible game outcomes, wherein the symbol interaction animates the array, to portray the game outcome.

2. The slot machine of claim 1, wherein the visual display is a video display.

3. The slot machine of claim 1, wherein each of the special symbols is associated with at least one of the other special symbols.

4. The slot machine of claim 1, wherein all of the symbols are special symbols.

5. The slot machine of claim 1, wherein the basic game has one or more themes and each special symbol relates to at least one of the themes.

6. The slot machine of claim 5, wherein the number of reels depends on the theme of the game.

7. The slot machine of claim 5, wherein the symbols in the array are arranged in visual association with one or more pay lines, the pay lines including at least one thematic pay line.

8. The slot machine of claim 7, wherein the thematic pay line is a scatter pay line.

9. The slot machine of claim 5, wherein the theme of the game is selected from a group consisting of football, basketball, baseball, golf, hockey, volleyball, soccer, bowling, archery, people, objects, animals, and vehicles.

10. The slot machine of claim 1, wherein an outcome of the interplay feature depends on an input from a player.

11. The slot machine of claim 1, wherein an arrangement and outcome of the interplay are determined at least in part by a proximity of the special symbols in the symbol array.

12. The slot machine of claim 1, wherein the interplay feature generates a payout depending at least in part on an outcome of the interplay feature.

13. The slot machine of claim 1, wherein an outcome of the interplay feature affects initialization or scoring of a subsequent round of the interplay feature.

14. The slot machine of claim 1, wherein the interplay feature includes an action screen shown on the visual display.

15. The slot machine of claim 14, wherein the action screen is superimposed over the symbols in the array.

16. The slot machine of claim 1, wherein the symbols in the array are arranged in visual association with one or more pay lines, the interplay feature illustrating the path of a pay line.

17. The slot machine of claim 1, wherein the number of reels is adjusted according to an outcome of the interplay feature.

18. The slot machine of claim 1, wherein a payout is determined at least in part by the symbol array before or after the interplay feature.

19. The slot machine of claim 1, wherein during the interplay feature the processor animates at least one of the symbols.

20. The slot machine of claim 1, wherein the interplay feature simulates a sports event.

21. The slot machine of claim 20, wherein the sports event is selected from the group consisting of a pitcher throwing a baseball, a hitter hitting a baseball, a catcher catching a baseball, a quarterback throwing a football to a receiver, a quarterback or receiver running with a football, a kicker kicking a football, a hurdler hurdling a hurdle, a pole vaulter vaulting a bar, a long jumper jumping a pit, and a basketball shooter throwing a basketball through a hoop.

22. The slot machine of claim 1, wherein the special symbol moves from a first position in the symbol array to a second position in the array.

23. The slot machine of claim 22, wherein the second position in the array is occupied by another special symbol.

24. The slot machine of claim 22, wherein the special symbol moves to a plurality of positions in the symbol array during the interplay feature.

25. The slot machine of claim 1, wherein at least one of the reels stops rotating after the processor initiates the interplay feature.

26. The slot machine of claim 1, wherein during the interplay the special symbol interacts with graphics on the display other than the symbols on the reels.

27. A method of operating a slot machine under control of a processor comprising:

a) providing a basic game including a plurality of simulated reels on a visual display;

b) in response to a wager amount, rotating and stopping the reels to arrange symbols on the reels in an array, the symbols on the reels including one or more special symbols; and c) providing an interplay feature in response to at least one of the special symbols appearing in the array, the interplay including a symbol interaction randomly selected from a plurality of possible symbol interactions between the special symbol and at least one other symbol, the selected symbol interaction to determine a game outcome from a plurality of possible game outcomes, and d) generating a payout based upon the game outcome.

28. The method of claim 27, wherein the visual display is a video display.

29. The method of claim 27, wherein each of the special symbols is associated with at least one of the other special symbols.

30. The method of claim 27, wherein all of the symbols are special symbols.

31. The method of claim 27, wherein the basic game has one or more themes and each special symbol relates to at least one of the themes.

32. The method of claim 31, wherein the number of reels depends on the theme of the game.

33. The method of claim 31, wherein the symbols in the array are arranged in visual association with one or more pay lines, the pay lines including at least one thematic pay line.

34. The method of claim 33, wherein the thematic pay line is a scatter pay line.

35. The method of claim 31, wherein the theme of the game is selected from a group consisting of football, basketball, baseball, golf, hockey, volleyball, soccer, bowling, archery, people, objects, animals, and vehicles.

36. The method of claim 27, wherein an outcome of the interplay feature depends on an input from a player.

37. The method of claim 27, Wherein an arrangement and outcome of the interplay are determined at least in part by a proximity of the special symbols in the symbol array.

38. The method of claim 27, wherein the interplay feature generates a payout depending at least in part on an outcome of the interplay feature.

39. The method of claim 27, wherein an outcome of the interplay feature affects initialization or scoring of a subsequent round of the interplay feature.

40. The method of claim 27, wherein the interplay feature includes an action screen shown on the visual display.

41. The method of claim 40, wherein the action screen is superimposed over the symbols in the array.

42. The method of claim 27, wherein the symbols in the array are arranged in visual association with one or more pay lines, the interplay feature illustrating the path of a pay line.

43. The method of claim 27, wherein the number of reels is adjusted according to an outcome of the interplay feature.

44. The method of claim 27, wherein the payout is determined at least in part by the symbol array before or after the interplay feature.

45. The method of claim 27, wherein during the interplay feature the processor animates at least one of the symbols.

46. The method of claim 27, wherein the interplay feature simulates a sports event.

47. The method of claims 46, wherein the sports event is selected from the group consisting of a pitcher throwing a baseball, a hitter hitting a baseball, a catcher catching a baseball, a quarterback throwing a football to a receiver, a quarterback or receiver running with a football, a kicker kicking a football, a hurdler hurdling a hurdle, a pole vaulter vaulting a bar, a long jumper jumping a pit, and a basketball shooter throwing a basketball through a hoop.

48. The method of claim 27, wherein the special symbol moves from a first position in the symbol array to a second position in the array.

49. The method of claim 48, wherein the second position in the array is occupied by another special symbol.

50. The method of claim 48, wherein the special symbol moves to a plurality of positions in the symbol array during the interplay feature.

51. The method of claim 27, wherein at least one of the reels stops rotating after the processor initiates the interplay feature.

52. The method of claim 27, wherein during the interplay the special symbol interacts with graphics on the display other than the symbols on the reels.

53. A slot machine comprising:

a basic game controlled by a processor in response to a wager amount, the basic game including a plurality of symbols randomly placed in a symbol array, the plurality of symbols including a plurality of special symbols; and an interplay feature activated by the processor in response to a pair of the special symbols appearing in the symbol array, the interplay including a symbol interaction randomly selected from a Plurality of possible symbol interactions between a pair of special symbols, the selected symbol interaction to determine a game outcome from a plurality of possible game outcomes, wherein the selected symbol interaction animates the array to portray the game outcome.

54. A slot machine comprising:

a basic game controlled by a processor in response to a wager amount, the basic game including a plurality of symbols randomly placed in a symbol array, the plurality of symbols including one or more special symbols; and an interplay feature activated by the processor in response to at least one of the special symbols appearing in the array, the interplay including a symbol interaction randomly selected from a plurality of possible symbol interactions between the special symbol and at least one other symbol,c the selected symbol interaction to determine a same outcome from a plurality of Possible game outcomes, the symbol interaction selected determined in part upon a player input, wherein the selected symbol interaction animates the array to portray the game outcome.

55. A slot machine comprising:

a basic game controlled by a processor in response to a wager amount, the basic game including a plurality of symbols randomly placed in a symbol array, the plurality of symbols including a plurality of special symbols; and an interplay feature activated by the processor in response to a pair of the special symbols appearing in the array, the interplay including a symbol interaction randomly selected from a plurality of possible symbol interactions between a pair of special symbols, the selected symbol interaction to determine a game outcome from a plurality of possible game outcomes, the symbol interaction selected determined at least in part by a proximity of the special symbols in the symbol array, wherein the symbol interaction animates the array to portray the game outcome.

56. A slot machine comprising:

a basic game controlled by a processor in response to a wager amount, the basic game including a plurality of symbols randomly placed in a symbol array in visual association with one or more pay lines, the plurality of symbols including one or more special symbols; and an interplay feature activated by the processor in response to at least one of the special symbols appearing in the array, the special symbol interacting graphically with one or more of the other symbols in the array to illustrate the path of one of the pay lines.

57. A slot machine comprising:

a basic game controlled by a processor in response to a wager amount, the basic game including a plurality of simulated reels on a visual display, the reels being rotated and stopped to arrange symbols on the reels in an array, the symbols on the reels including one or more special symbols; and an interplay feature activated by the processor in response to at least one of the special symbols appearing in the array, the special symbol interacting graphically with one or more of the other symbols in the array, the number of reels being adjusted according to an outcome of the interplay feature.

58. A slot machine comprising:

a basic game controlled by a processor in response to a wager amount, the basic game including a plurality of symbols randomly placed in a symbol array, the plurality of symbols including one or more special symbols; and an interplay feature activated by the processor in response to at least one of the special symbols appearing in the array, the interplay including a symbol interaction randomly selected from a plurality of possible symbol interactions between the special symbol and at least one other symbol in the array, the selected symbol interaction to determine a game outcome from a plurality of possible game outcomes, the interplay to simulate a sports event wherein the symbol interaction animates the array to portray the game outcome for the sports event.

59. The slot machine of claim 58, wherein the sports event is selected from the group consisting of a pitcher throwing a baseball, a hitter hitting a baseball, a catcher catching a baseball, a quarterback throwing a football to a receiver, a quarterback or receiver running with a football, a kicker kicking a football, a hurdler hurdling a hurdle, a pole vaulter vaulting a bar, a long jumper jumping a pit, and a basketball shooter throwing a basketball through a hoop.

60. A slot machine comprising:

a basic game controlled by a processor in response to a wager amount, the basic game including a plurality of simulated reels on a visual display, the reels being rotated and stopped to arrange symbols on the reels in an array, the symbols on the reels including one or more special symbols; and an interplay feature activated by the processor in response to at least one of the special symbols appearing in the array, the interplay including a symbol interaction randomly selected from a plurality of symbol interactions between the special symbol and at least one other symbol in the array, the selected symbol interaction to determine a game outcome from a plurality of possible game outcomes, wherein at least one of the reels stops rotating after the processor initiates the interplay feature.

61. A slot machine comprising:

a basic game controlled by a processor in response to a wager amount, the basic game including a plurality of simulated reels on a visual display, the reels being rotated and stopped to arrange symbols on the reels in an array, the symbols on the reels including at least a pair of special symbols with a predefined relationship; and an interplay feature activated by the processor in response to the pair of special symbols appearing in the array, the interplay including a symbol interaction randomly selected from a plurality of possible symbol interactions between a pair of special symbols interacting graphically with each other in an animated event, the selected symbol interaction to determine a game outcome from a plurality of possible game outcomes for the array, wherein the symbol interaction animates the array to portray the game outcome for the animated event.

62. A method of operating a slot machine under control of a processor comprising:

a) providing a basic game including a plurality of simulated reels on a visual display;

b) in response to a wager amount, rotating and stopping the reels to arrange symbols on the reels in an array, the symbols on the reels including one or more special symbols; and c) providing an interplay feature in response to at least one of the special symbols appearing in the array, the special symbol and at least one other symbol moving relative to the other symbols in the array to portray one of a plurality of randomly selectable interactions, wherein the selected interaction determines the game outcome; and d) generating a payout based upon the game outcome.

63. A method of operating a slot machine having a plurality of symbols on simulated reels visible on a display comprising:

a) randomly arranging the symbols on the reels to form an array in response to a wager;

b) triggering an interplay feature when a predetermined event occurs in the array;

c) randomly selecting a symbol interaction from a plurality of possible symbol interactions between selected symbols in the array for the interplay feature, the selected symbol interaction for determining a winning or losing game outcome;

d) portraying the selected symbol interaction as an animated event; and e) generating a payout based upon the game outcome.

64. A slot machine comprising:

a basic game controlled by a processor in response to a wager amount, the basic game including a plurality of simulated reels on a visual display, the reels being rotated and stopped to arrange symbols on the reels in an array, the symbols on the reels including one or more special symbols; and an interplay feature activated by the processor in response to at least one of the special symbols appearing in the array, the interplay including a symbol interaction randomly selected from a plurality of symbol interactions for the array between the special symbol and at least one other symbol, the selected symbol interaction to determine a game, wherein the game outcome is not discernible from the stopped array.

65. A slot machine comprising:

a basic game controlled by a processor in response to a wager amount, the basic game including a plurality of simulated reels on a visual display, the reels being rotated and stopped to arrange symbols on the reels in an array, the symbols on the reels including one or more special symbols; and an interplay feature activated by the processor in response to at least one of the special symbols appearing in the array, the interplay including a symbol interaction between the special symbol and at least one other symbol, the interplay having a game outcome determined by randomly selecting one of a plurality of possible symbol interactions for the stopped array, wherein the selected symbol interaction graphically animates the array to display the game outcome.

66. A slot machine comprising:

a basic game controlled by a processor in response to a wager amount, the basic game including a plurality of simulated reels on a visual display, the reels being rotated and stopped to arrange symbols on the reels in an array, the symbols on the reels including one or more special symbols; and an interplay feature activated by the processor in response to at least one of the special symbols appearing in the array, the interplay including a symbol interaction between the special symbol and at least one other symbol, the interplay having a game outcome determined by randomly selecting one of a plurality of possible symbol interactions independent of the symbol arrangement in the array.

* * * * *